US008821199B2

(12) United States Patent
Sandoval et al.

(10) Patent No.: US 8,821,199 B2
(45) Date of Patent: Sep. 2, 2014

(54) MULTI-PRONG POWER TIP ADAPTOR

(75) Inventors: Arthur G. Sandoval, San Francisco, CA (US); Wenson Chern, Mountain View, CA (US); Guangqun Max Chen, San Francisco, CA (US)

(73) Assignee: Targus Group International, Inc., Anaheim, CA (US)

( * ) Notice: Subject to any disclaimer, the term of this patent is extended or adjusted under 35 U.S.C. 154(b) by 149 days.

(21) Appl. No.: 13/557,947

(22) Filed: Jul. 25, 2012

(65) Prior Publication Data

US 2014/0030936 A1 Jan. 30, 2014

(51) Int. Cl.
*H01R 4/18* (2006.01)

(52) U.S. Cl.
USPC ..... 439/866

(58) Field of Classification Search
USPC ..... 439/825–826, 842–843, 851–857, 862, 439/675, 861, 63, 578, 581
See application file for complete search history.

(56) References Cited

U.S. PATENT DOCUMENTS

| | | | | |
|---|---|---|---|---|
| 4,543,624 | A | 9/1985 | Rumble | |
| 4,626,052 | A | 12/1986 | Rumble | |
| 5,347,211 | A | 9/1994 | Jakubowski | |
| 5,479,331 | A | 12/1995 | Lenni | |
| 5,486,123 | A * | 1/1996 | Miyazaki | 439/825 |
| 5,547,399 | A | 8/1996 | Naghi et al. | |
| 5,636,110 | A | 6/1997 | Lanni | |
| 5,744,934 | A | 4/1998 | Wu | |
| 5,838,554 | A | 11/1998 | Lanni | |
| 5,949,213 | A | 9/1999 | Lanni | |
| 6,035,187 | A | 3/2000 | Franza | |
| 6,038,127 | A | 3/2000 | Ries | |
| 6,064,177 | A | 5/2000 | Dixon | |
| 6,091,611 | A | 7/2000 | Lanni | |
| 6,137,280 | A | 10/2000 | Ackermann et al. | |
| 6,140,934 | A | 10/2000 | Lam | |
| 6,172,884 | B1 | 1/2001 | Lanni | |
| 6,191,552 | B1 | 2/2001 | Kates et al. | |

(Continued)

FOREIGN PATENT DOCUMENTS

| | | |
|---|---|---|
| CA | 2 403 856 | 10/2001 |
| EP | 1 603 218 A2 | 12/2005 |
| EP | 1 811 614 A2 | 7/2007 |
| EP | 1 372 254 B1 | 7/2008 |
| EP | 1 575 152 B1 | 4/2009 |
| EP | 1 273 093 B1 | 7/2009 |
| WO | WO 01/76051 A2 | 10/2001 |
| WO | WO 03/038980 A1 | 5/2003 |

(Continued)

OTHER PUBLICATIONS

Non-final Office Action for U.S. Appl. No. 13/472,222, filed May 15, 2012, and mailed from the USPTO on Oct. 28, 2013, 15 pgs.

(Continued)

*Primary Examiner* — Jean F Duverne
(74) *Attorney, Agent, or Firm* — John R. Thompson; Stoel Rives LLP

(57) ABSTRACT

Consolidated power tips allow a power adaptor to be connected to disparately sized input ports of electronic devices. The consolidated power tips may be sized to balance insertion and pull-out forces for the disparately sized input ports. Deformable members may be added to the consolidated power tips for more desirable insertion and pull-out forces and improved electrical contact. For input ports with different electrical requirements, a mode selector may be added to the consolidated power tip to select between the electrical requirements of the different input ports. The consolidated power tips may be combined into a multi-prong power tip. The multi-prong power tip allows users to interface with a large number of disparate devices without changing power tips.

22 Claims, 18 Drawing Sheets

(56) References Cited

U.S. PATENT DOCUMENTS

| | | | | |
|---|---|---|---|---|
| 6,212,088 | B1 | 4/2001 | Yoo | |
| 6,266,261 | B1 | 7/2001 | Lanni | |
| 6,299,489 | B1 * | 10/2001 | Phillips et al. | 439/675 |
| 6,433,274 | B1 | 8/2002 | Doss et al. | |
| 6,459,604 | B1 | 10/2002 | Youn et al. | |
| 6,538,341 | B1 | 3/2003 | Lang | |
| D473,848 | S | 4/2003 | Zheng et al. | |
| 6,643,158 | B2 | 11/2003 | McDonald et al. | |
| 6,650,560 | B2 | 11/2003 | MacDonald et al. | |
| 6,664,758 | B2 | 12/2003 | Yang | |
| 6,693,413 | B1 | 2/2004 | Lanni | |
| 6,700,808 | B2 | 3/2004 | MacDonald et al. | |
| 6,707,284 | B2 | 3/2004 | Lanni | |
| 6,751,109 | B2 | 6/2004 | Doss et al. | |
| 6,765,365 | B2 | 7/2004 | Kim et al. | |
| 6,775,163 | B2 | 8/2004 | McDonald et al. | |
| 6,791,853 | B2 | 9/2004 | Afzal et al. | |
| 6,805,579 | B2 | 10/2004 | Marchand et al. | |
| 6,809,943 | B2 | 10/2004 | Lanni | |
| 6,831,848 | B2 | 12/2004 | Lanni | |
| 6,836,101 | B2 | 12/2004 | Lanni | |
| 6,850,423 | B2 | 2/2005 | Lanni | |
| 6,894,457 | B2 | 5/2005 | Germagian et al. | |
| 6,903,950 | B2 | 6/2005 | Afzal et al. | |
| 6,920,056 | B2 | 7/2005 | MacDonald et al. | |
| 6,922,347 | B2 | 7/2005 | Lanni | |
| 6,934,561 | B2 | 8/2005 | Burrus, IV | |
| 6,937,490 | B2 | 8/2005 | MacDonald et al. | |
| 6,939,150 | B1 | 9/2005 | Lanni | |
| 6,976,885 | B2 | 12/2005 | Lord | |
| 7,035,126 | B1 | 4/2006 | Lanni | |
| 7,041,400 | B2 | 5/2006 | Kim et al. | |
| 7,056,149 | B1 | 6/2006 | Lanni | |
| 7,072,200 | B2 | 7/2006 | Lanni | |
| 7,139,181 | B2 | 11/2006 | Afzal et al. | |
| 7,140,921 | B2 | 11/2006 | Liu | |
| 7,142,423 | B2 | 11/2006 | Lanni | |
| 7,145,312 | B2 | 12/2006 | Lanni | |
| 7,145,787 | B2 | 12/2006 | Lanni | |
| 7,148,659 | B2 | 12/2006 | Lanni | |
| 7,153,169 | B2 | 12/2006 | Lord | |
| 7,193,398 | B2 | 3/2007 | Lanni | |
| 7,193,873 | B2 | 3/2007 | Lanni | |
| 7,224,086 | B2 | 5/2007 | Germagian et al. | |
| 7,254,048 | B2 | 8/2007 | Lanni | |
| 7,265,973 | B2 | 9/2007 | Lanni | |
| 7,266,003 | B2 | 9/2007 | Lanni | |
| 7,273,384 | B1 | 9/2007 | So | |
| 7,279,868 | B2 | 10/2007 | Lanni | |
| 7,352,158 | B2 | 4/2008 | Remson | |
| 7,355,851 | B2 | 4/2008 | Lanni | |
| 7,365,524 | B2 | 4/2008 | Lanni | |
| 7,365,973 | B2 | 4/2008 | Rasmussen et al. | |
| 7,377,805 | B2 | 5/2008 | Kim et al. | |
| 7,388,305 | B2 | 6/2008 | McCoy et al. | |
| 7,420,823 | B2 | 9/2008 | Lanni | |
| 7,450,390 | B2 | 11/2008 | Lanni | |
| 7,450,403 | B2 | 11/2008 | Lanni | |
| 7,453,171 | B2 | 11/2008 | Lanni | |
| 7,456,714 | B2 | 11/2008 | McCoy et al. | |
| 7,460,381 | B2 | 12/2008 | Lanni | |
| 7,489,116 | B2 | 2/2009 | Lanni | |
| 7,495,941 | B2 | 2/2009 | Lanni | |
| 7,502,233 | B2 | 3/2009 | Kim et al. | |
| 7,545,656 | B2 | 6/2009 | Lanni | |
| 7,597,570 | B2 | 10/2009 | So | |
| 7,613,021 | B2 | 11/2009 | Lanni | |
| 7,642,671 | B2 | 1/2010 | Mahaffey | |
| 7,646,107 | B2 | 1/2010 | Smith | |
| 7,649,279 | B2 | 1/2010 | Lanni | |
| 7,727,005 | B2 | 6/2010 | Lanni | |
| 7,736,194 | B1 | 6/2010 | Chang | |
| 7,899,657 | B2 | 3/2011 | Martin | |
| 8,113,855 | B2 | 2/2012 | Green et al. | |
| 8,149,570 | B2 | 4/2012 | Keebler et al. | |
| 8,162,672 | B2 * | 4/2012 | Huang | 439/63 |
| 8,460,017 | B1 | 6/2013 | Green et al. | |
| 2003/0042881 | A1 | 3/2003 | Lanni | |
| 2003/0119442 | A1 | 6/2003 | Kwak et al. | |
| 2003/0128020 | A1 | 7/2003 | Lanni | |
| 2003/0132668 | A1 | 7/2003 | Lanni | |
| 2003/0228792 | A1 | 12/2003 | Lanni | |
| 2004/0003498 | A1 * | 1/2004 | Swearingen et al. | 29/862 |
| 2004/0108833 | A1 | 6/2004 | Lanni | |
| 2004/0130304 | A1 | 7/2004 | Lanni | |
| 2004/0203897 | A1 | 10/2004 | Rogers | |
| 2004/0240236 | A1 | 12/2004 | Lanni | |
| 2004/0257835 | A1 | 12/2004 | Lanni | |
| 2005/0021870 | A1 | 1/2005 | Carnahan et al. | |
| 2005/0024907 | A1 | 2/2005 | Lanni | |
| 2005/0117376 | A1 | 6/2005 | Wilson | |
| 2005/0141252 | A1 | 6/2005 | Mollo | |
| 2005/0162020 | A1 | 7/2005 | Lanni | |
| 2005/0201124 | A1 | 9/2005 | Lanni | |
| 2005/0266730 | A1 | 12/2005 | Lanni | |
| 2006/0007715 | A1 | 1/2006 | MacDonald et al. | |
| 2006/0020557 | A1 | 1/2006 | Nixon | |
| 2006/0105619 | A1 | 5/2006 | Lanni | |
| 2006/0183381 | A1 | 8/2006 | Lanni | |
| 2006/0187696 | A1 | 8/2006 | Lanni | |
| 2006/0202557 | A1 | 9/2006 | Menas et al. | |
| 2006/0215381 | A1 | 9/2006 | Lanni | |
| 2006/0227580 | A1 | 10/2006 | Lanni | |
| 2006/0250829 | A1 | 11/2006 | Lanni | |
| 2006/0250830 | A1 | 11/2006 | Lanni | |
| 2006/0256595 | A1 | 11/2006 | Lanni | |
| 2006/0279139 | A1 | 12/2006 | Stefancscu | |
| 2006/0279928 | A1 | 12/2006 | Lanni | |
| 2007/0035287 | A1 | 2/2007 | DuBose et al. | |
| 2007/0055791 | A1 | 3/2007 | Wood et al. | |
| 2007/0073420 | A1 | 3/2007 | Lanni | |
| 2007/0099519 | A1 | 5/2007 | Lord | |
| 2007/0171593 | A1 | 7/2007 | DuBose | |
| 2007/0175655 | A1 | 8/2007 | Swanson et al. | |
| 2007/0182388 | A1 | 8/2007 | Lanni | |
| 2007/0279952 | A1 | 12/2007 | Lanni | |
| 2007/0296380 | A1 | 12/2007 | Lanni | |
| 2007/0297134 | A1 | 12/2007 | Lanni | |
| 2008/0007212 | A1 | 1/2008 | Theytaz et al. | |
| 2008/0012425 | A1 | 1/2008 | Lanni | |
| 2008/0012427 | A1 | 1/2008 | Wilson et al. | |
| 2008/0019154 | A1 | 1/2008 | Lanni | |
| 2008/0019156 | A1 | 1/2008 | Lanni | |
| 2008/0151581 | A1 | 6/2008 | Lanni | |
| 2008/0164764 | A1 | 7/2008 | So | |
| 2008/0231233 | A1 | 9/2008 | Thornton | |
| 2008/0268717 | A1 * | 10/2008 | Mao | 439/675 |
| 2009/0021189 | A1 | 1/2009 | DuBose et al. | |
| 2009/0096565 | A1 | 4/2009 | Lanni | |
| 2009/0197457 | A1 | 8/2009 | Lanni | |
| 2010/0058409 | A1 | 3/2010 | Chapman et al. | |
| 2010/0109436 | A1 | 5/2010 | Lanni | |
| 2010/0190384 | A1 | 7/2010 | Lanni | |
| 2010/0254162 | A1 | 10/2010 | Lanni | |
| 2010/0283330 | A1 | 11/2010 | Lanni | |

FOREIGN PATENT DOCUMENTS

| | | | |
|---|---|---|---|
| WO | WO 2004/082110 | A2 | 9/2004 |
| WO | WO 2004/082110 | A3 | 9/2004 |
| WO | WO 2005/015721 | A1 | 2/2005 |
| WO | WO 2008/008209 | A2 | 1/2008 |

OTHER PUBLICATIONS

International Search Report for PCT/US05/35242 filed Sep. 30, 2005, and mailed Jul. 21, 2008, 5 pgs.

Written Opinion of the International Search Authority for PCT/US05/35242 filed Sep. 30, 2005, and mailed Jul. 21, 2008, 9 pgs.

Notice of Allowance and Fee(s) Due for U.S. Appl. No. 13/557,976, filed Jul. 25, 2012, and mailed from the USPTO Sep. 4, 2013, 15 pgs.

* cited by examiner

MULTI-PRONG POWER TIP ADAPTOR

TECHNICAL FIELD

This disclosure relates to power tips for power adaptors.

DETAILED DESCRIPTION OF PREFERRED EMBODIMENTS

Figure 1A:
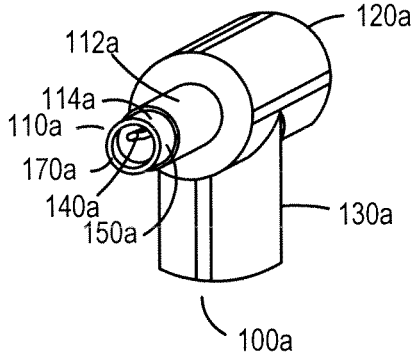
FIGS. 1A-C are front angled views of consolidated power tips.

Consumer electronics and other electronic devices often need electrical power to power the device and/or charge one or more batteries. These electronic devices may include computers, laptops, tablets, mobile telephones, smart phones, personal digital assistants ("PDAs"), personal media players, and the like. Electronic devices require that electrical power comply with electrical requirements of the device. Electronic devices may require that the electrical power be supplied as direct current ("DC"), that a voltage between the terminals is within one or more predetermined ranges, and a certain current level be supplied. Because most power sources, such as household outlets, automobile and other vehicle outlets, and the like, are alternating current ("AC") or are at a voltage outside the predetermined range, a power adaptor is needed to convert electricity from the power source such that it complies with the electrical requirements of the electronic device.

If the electronic device receives electrical power that does not comply with the electrical requirements, it may damage the electronic device. Electronic devices have physically distinct electrical input ports to prevent a potentially damaging connection with a power source not meeting the electronic devices' electrical requirements. Conventional power adaptors are generally designed to satisfy the electrical requirements of a single electronic device. These power adaptors are only designed to interface with the electrical input port for that particular electronic device.

Instead, a programmable power adaptor may be programmed to adapt to the electrical requirements of a plurality of electrical devices. This may involve manual selection by a user or an automatic determination of the electrical requirements. Alternatively, a power adaptor may be designed to output electrical power at a voltage and current that meets the requirements of the electrical requirements of multiple electronic devices. Such universal power adaptors should also be able to physically interface with input ports of the electronic devices. The power adaptors may have an intermediate output connector that interfaces with variably sized power tips. Each power tip is designed to physically and electrically couple with an input port of an electronic device through a device interface and to physically and electrically couple with the intermediate output connector through an adaptor interface. Input ports and device interfaces may be various shapes, including, but not limited to, cylindrical, rectangular, trapezoidal, or the like. The power tips are further designed to electrically couple the input port with the power adapter via the intermediate output connector. In some embodiments, the programmable power adaptor may automatically determine the electrical requirements of the input port based on the power tip connected to it.

Because of the large variety of input ports for electrical devices, universal power adaptors may come with large numbers of disparate power tips. This requires power adaptor manufacturers to design and manufacture the large number of disparate power tips, which can make the manufacturing process less efficient. Additionally, consumers may purchase power tips they do not need, which can lead to waste and extra expense for the consumer. These problems may be alleviated by designing power tips that are able to interface with multiple variably sized input ports.

Power tips are designed to be held in place by a frictional force between the power tip and the input port. The frictional force arises from contact between surfaces of the device interface and surfaces of the input port. The frictional force depends on the materials of the power tip and input port and the normal force between the power tip and input port. The normal force depends on the size and shape of the power tip and input port. As the elements of the power tip and input port contact and attempt to occupy the same space, those elements will be deformed and will exert a force resisting deformation, a component of which will be the normal force. The size and shape of the power tip controls the extent that the input port and power tip attempt to occupy the same space, and accordingly, the deformation resisting force.

The frictional force results in the power tips having an insertion resistance and a pull resistance. A user will need to apply an insertion force sufficient to overcome the insertion resistance to insert the power tip into the input port of the electrical device. If the insertion resistance is too high, it will be difficult for users to insert the power tip into the electronic device. A user will need to apply a pull-out force sufficient to overcome the pull resistance to remove the power tip from the electronic device. If the pull resistance is too low, the power tip may dislodge from the input port when a user does not desire it to do so. Accordingly, improper insertion and pull resistances can have a large, negative impact on the experience of a user.

The insertion resistance and pull resistance for a power tip can be modified by changing sizes and shapes of the elements of the power tip during design to increase or reduce the normal and frictional forces. Because the insertion resistance is often correlated to the pull resistance, power tips may be designed to appropriately balance the insertion resistance and the pull resistance. An acceptable insertion resistance may be no more than a threshold, such as 2, 3, 4, 5, 6, 7, 8, 9, or 10 lbs. Above this threshold, the power tip may be unusable due to an inability to insert the power tip and/or may create strong negative reactions from some users. An acceptable pull resistance may be no less than a threshold, such as 0.5, 1, 1.5, 2, 2.5, 3, 3.5, or 4 lbs. Below this threshold, the power tip may become dislodged frequently enough to annoy users or substantially interfere with powering the electronic device. Instead of using thresholds, the power tip may be designed to come as close as possible to a target insertion resistance and/or a target pull resistance.

Consolidated Power Tips

Figure 1B:
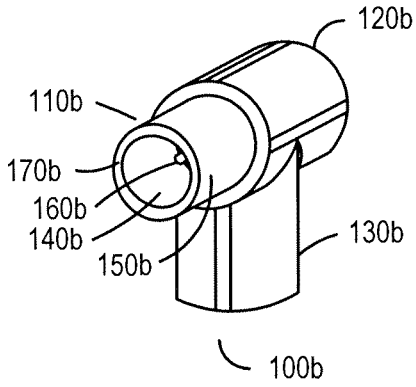
Figure 1C:
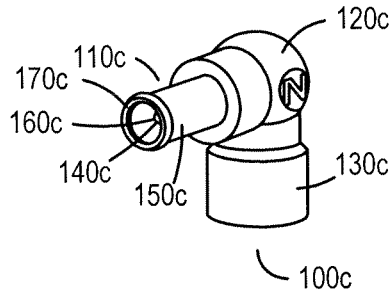

FIGS. 1A-C are angled front views of consolidated power tips for many common input ports. Each power tip 100*a-c* in the illustrated embodiments has a device interface 110*a-c* comprising at least two electrical contacts 140*a-c*, 150*a-c* to interface with the input port of the electronic device. The device interface 110*a-c* may comprise a cylinder with at least one of the electrical contacts disposed there on. The device interface 110*a-c* extends from a housing 120*a-c* that protects wires (not shown) and their connections to the electrical contacts 140*a-c*, 150*a-c* from damage. The housing 120*a-c* may be plastic, rubber, or the like. An insulating section 170*a-c* may prevent the electrical contacts 140*a-c*, 150*a-c* from directly electrically coupling with each other, which might create a short circuit. A base 130*a-c* of the housing 120*a-c* is designed to interface with the intermediate output connector of a power supply (not shown). The bottom of the base 130*a-c* comprises an adaptor interface with electrically conductive pins or other electrically conductive contacts. The intermediate output connector can be removably coupled with the adaptor interface. Some embodiments may have a center pin 160*b-c*, which can have a voltage rail 140*c* disposed on its surface.

A first consolidated power tip 100*a* may comprise a device interface 110*a* comprising a cylinder. A first electrical contact 140*a* may be disposed on an inner surface of the cylinder, and a second electrical contact 150*a* may be disposed on an outer surface of the cylinder. The first electrical contact 140*a* may be electrically conductive material on the inner surface of the cylinder, or as illustrated, one or more arched strips of conductive material may run longitudinally along the inner surface of the cylinder. Similarly, the second electrical contact 150*a* may be conductive material on the outer surface of the cylinder, or some or all of the cylinder may be made from an electrically conductive material. The cylinder may further comprise the insulating section 170*a* that prevents direct electrical coupling of the electrical contacts 140*a*, 150*a*. The cylinder may also comprise differently sized sections. In the illustrated embodiment, a first cylindrical section 112*a* is disposed proximally to the housing 120*a* and a second cylindrical section 114*a* is disposed distally from the housing 120*a*. An outer circumference of the first cylindrical section 112*a* is larger than an outer circumference of the second cylindrical section 114*a*, but inner circumferences of each cylindrical section 112*a*, 114*a* are equal. Depending on the input ports the consolidated tip is designed to fit, the cylinder may comprise additional section, the inner circumferences may vary between sections, or outer circumferences may be sized differently.

Figure 2A:
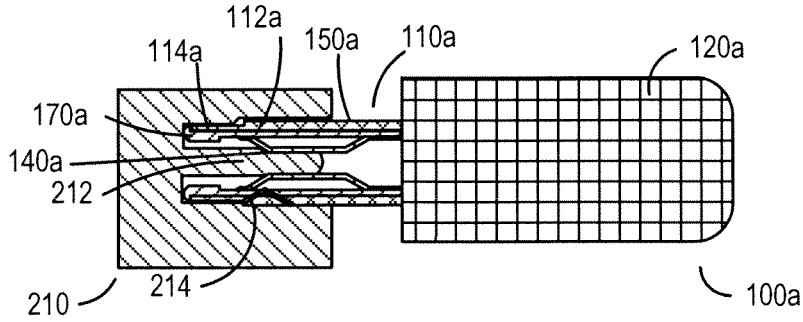
FIGS. 2A-F are cross-section views of the consolidated power tips interfacing with input ports of varying sizes.
Figure 2B:
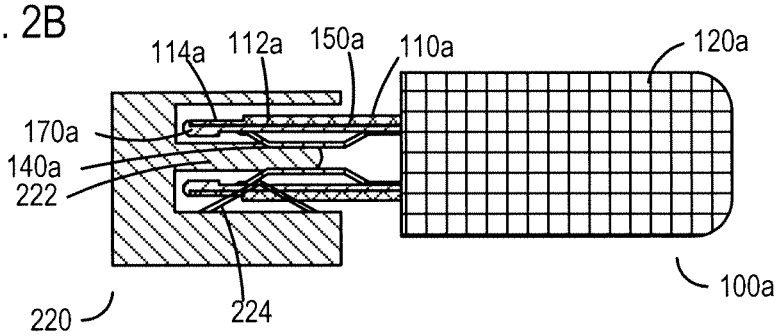
Figure 2C:
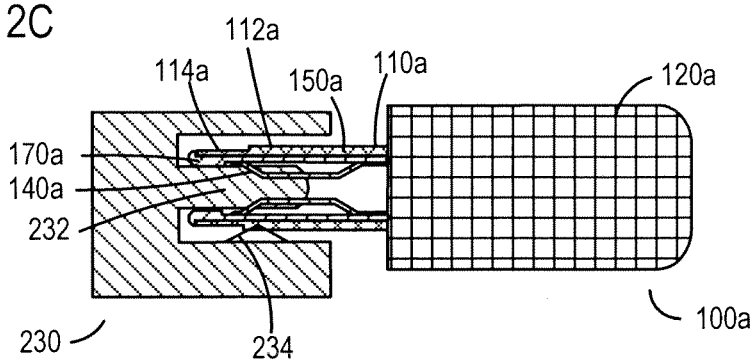

FIGS. 2A-C are cross-section views of the first consolidated tip 100*a* interfacing with input ports 210, 220, 230 of varying sizes and design. Each illustrated input port 210, 220, 230 comprises a cylindrical void into which the device interface 110*a* may be inserted. Each input port 210, 220, 230 also comprises a pin 212, 222, 232 that electrically couples with the first electrical contact 140*a*. The arch shape allows the first electrical contact 140*a* to electrically couple with the smaller pin 212 of the first input port 210, but it flexes to still allow insertion of the larger pin 232 of the third input port 230, without too large of an insertion resistance. The input ports 210, 220, 230 may comprise electrical contacts 214, 224, 234 on the surface surrounding the cylindrical void. The second electrical contact 150*a* of the power tip 100*a* may electrically couple with these electrical contacts 214, 224, 234.

The consolidated power tip 100*a* is designed to ensure electrical coupling with each desired input port 210, 220, 230 while maintaining acceptable insertion and pull resistances. Design variables include: the outer and inner circumferences of the cylinder; the number of arched strips, the length of the arched strips, the height of the arched strips from the cylinder, and the rigidity of the arched strips; and other variations of the size and shape of the device interface 110*a*. The size and shape may be selected by choosing target insertion and/or pull-out resistances and minimizing the deviation of resistances for input ports 210, 220, 230 of interest from the target resistance values. Minimizing deviation may comprise minimizing the maximum deviation of any resistance from the target resistance values; minimizing the average deviation of all resistances from the target resistance values; or the like. Alternatively, the size and shape may be selected to ensure that the insertion resistance for each input port is below a predetermined threshold and the pull resistance for each input port is above a predetermined threshold. Different aspects of the size and shape may be altered to ensure that the interaction with each input port is within the predetermined thresholds.

In the illustrated embodiment, the outer circumference of the device interface 110*a* is large enough to frictionally engage with the outer walls of the cylindrical void of input port 210. This provides a pull resistance for input port 210 above a desired threshold, while contributing little to the insertion resistance of input ports 220 and 230. The arched strips and inner circumference are selected to balance the pull resistance of input port 220 with the insertion resistance of input port 230. The inner circumference is large enough to interface with the largest pin 232 without the insertion resistance exceeding the desired threshold. Yet, it still provides an adequate pull resistance for the input port 230. Additionally, the arched strips are deformable, so the largest pin 232 still fits in the device interface 110*a* even though it is wider than the space between the arched strips. For input port 220, the arched strips are sufficiently arched and rigid to engage frictionally with the pin 222 and provide pull resistance above the desired threshold. The large electrical contact 224 of the input port 220 can also contribute to the pull resistance. The device interface 110*a* is thus able to maintain acceptable insertion and pull resistances across a plurality of input ports 210, 220, 230.

A second consolidated power tip 100*b* may also comprise a device interface 110*b* comprising a cylinder. A first electrical contact 140*b* may again be disposed on an inner surface of the cylinder, and a electrical contact 150*b* may again be disposed on the outer surface of the cylinder. Additionally, the device interface 110*b* of the consolidated power tip 100*b* may comprise a center pin 160*b*. The center pin 160*b* may be a smart pin able to communicate power supply identification ("PSID") information or the like between the electronic device and the power adaptor. The power tip 100*b* may comprise a memory containing the PSID information and/or a resistor for providing the smart pin programming. Alternatively, the memory and/or resistor may be in the power adaptor and the adaptor interface may electrically couple the center pin 160*b* with the memory. In some embodiments, a user may be able to select whether to use the memory or the resistor to provide the smart pin programming. In other embodiments, the center pin 160*b* may act as the first electrical contact 140*b*, or a user may be able to select whether the center pin 160*b* or the inner surface of the cylinder acts as the first electrical contact 140*b*.

Figure 2D:
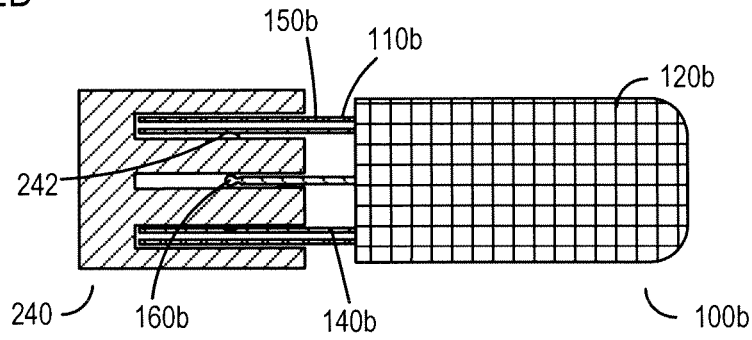
Figure 2E:
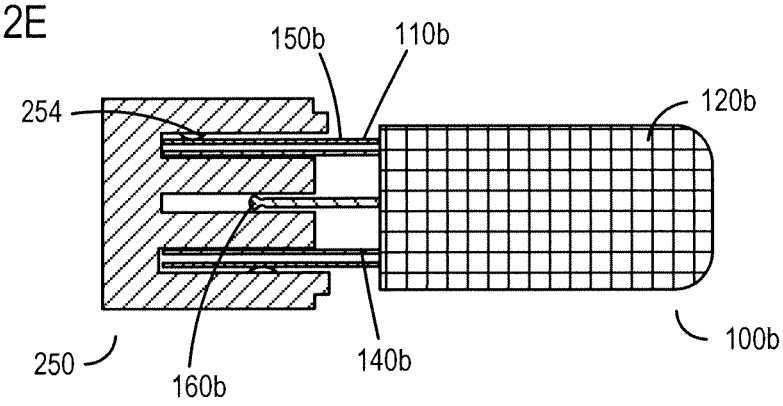

As shown in the cross-section views in FIGS. 2D and 2E, the consolidated power tip 100*b* may interface with input ports 240, 250 that have concentric cylindrical voids to interface with the consolidated power tip's 100*b* cylinder and pin 160*b*. Electrical contacts 242, 254 may be on the inner or outer surface of the cylindrical voids to couple with the device interface 110*b*. As before, the outer and inner circumferences of the cylinder are selected to ensure electrical contact with each desired input port 240, 250. The pin 160*b* is sized to ensure that it also makes electrical contact with each input port 240, 250 either as a first electrical contact or to communicate PSID information.

In the illustrated embodiment, the device interface 110*b* does not comprise arched strips. The insertion and pull resistance are instead controlled by varying the outer and inner circumference of the device interface 110*b*. Additionally, the circumference of the pin 160*b* may also be varied to alter the insertion or pull resistances of the various input ports 240, 250. In some embodiments, the desired input ports 240, 250 are sized and shaped, such that the outer circumference can be sized to create pull resistance above the required threshold for one input port while the inner circumference can be sized to create pull resistance above the required threshold for the another input port. The pin 160*b* might then be sized to create a threshold pull resistance with another input port.

In other cases, the outer cylindrical void of one input port may have both a larger outer circumference and smaller inner circumference than the other input port. This may prevent one input port from having a pull resistance above the necessary threshold without the other input port having an insertion resistance exceeding the allowable threshold. In these cases, the pin 160*b* may be sized large enough to create the desired pull resistance with the one input port while the outer and inner circumference are sized to create a greater than threshold pull resistance with the other input port. In some embodiments, arched strips may be added to the pin 160*b* to adjust the insertion and pull resistances as well.

Figure 2F:
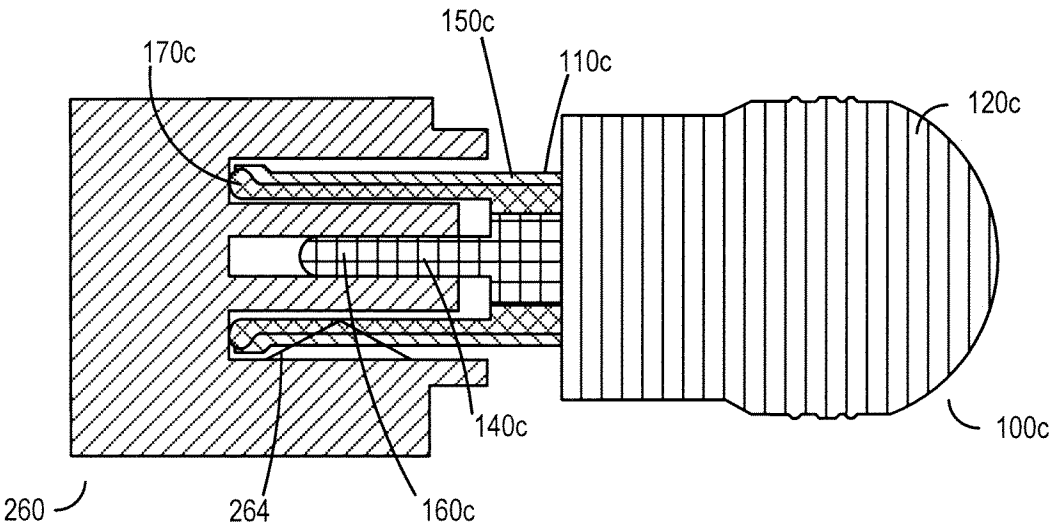
Figure 3A:
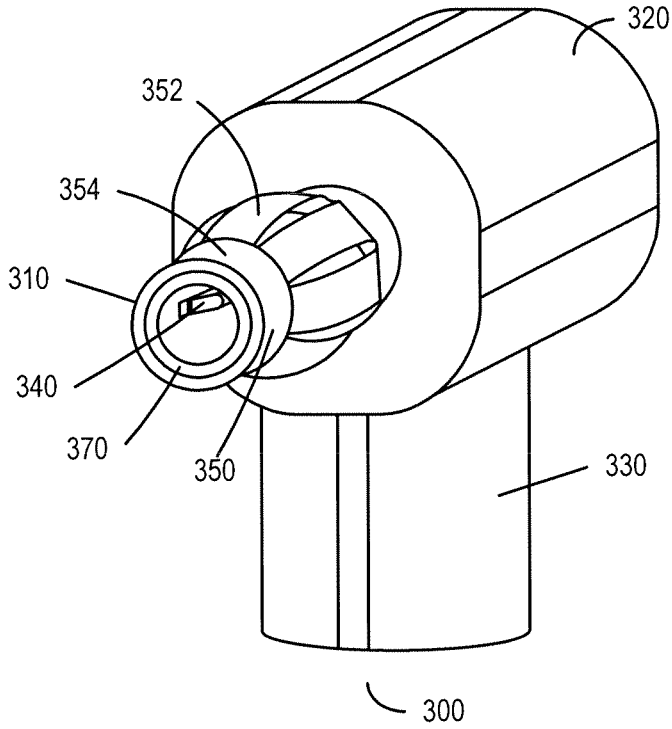
FIGS. 3A and B are a front angled view and a head-on view of an embodiment of a consolidated power tip with deformable members incorporated into the electrical contacts.
Figure 3B:
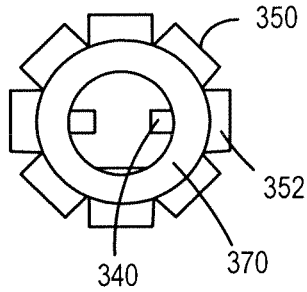

A third consolidated power tip 100*c* may comprise device interface 110*c* comprising a pin 160*c* with a first electrical contact 140*c* disposed on its surface. The device interface 110*c* may further comprise a cylinder with the second electrical contact 150*c* disposed on the outer surface of the cylinder but not the inner surface. An insulating section 170*c* may then insulate the electrical contact s 140*c*, 150*c* from direct electrical coupling. As shown in the cross-section view in FIG. 2F, the consolidated power tip 100*c* may interface with an input port 260 with an electrical contact 264 on an outer surface surrounding an outer cylindrical void. The outer and inner circumferences of the cylinder and the circumference of the pin 160*c* may again be selected to ensure electrical contact with each desired input port 260 while maintaining acceptable insertion and pull resistances. Consolidated Power Tips with Deformable Members FIGS. 3A and 3B are a front angled view and a head-on view of a fourth consolidated power tip 300 with deformable members. Like the first consolidated power tip 100*a*, the consolidated power tip 300 may comprise a housing 320, a base 330, and a device interface 310 comprising a cylinder. A first electrical contact 340 may be disposed on the inner surface of the cylinder and a second electrical contact 350 may be disposed on the outer surface of the cylinder. The first and second electrical contacts 340, 350 may be separated by an insulating section 370. In the illustrated embodiment, the first electrical contact 340 comprises two deformable members. The deformable members are arched strips that run longitudinally along the internal surface of the cylinder. The second electrical contact 350 may comprise a plurality of deformable members 352 running longitudinally along the outer surface of the cylinder. The deformable members 352 on the outer surface may also be arch shaped with a height above the outer surface of the cylinder. The deformable members 352 may be made from metal or other metallic substances in some embodiments. A portion 354 of the second electrical contact 350 may not have any deformable members.

Figure 5A:
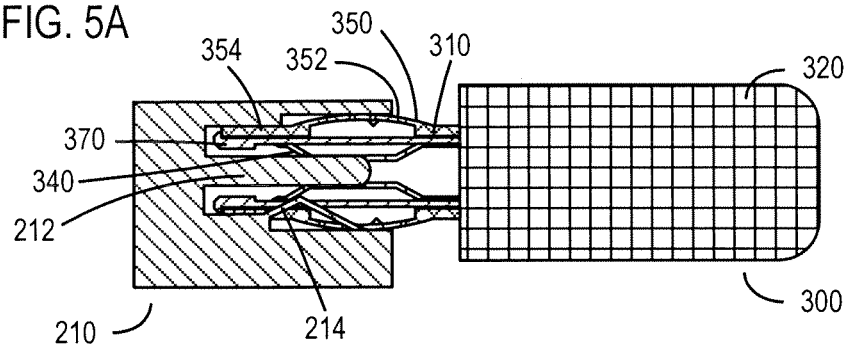
FIGS. 5A-E are cross-section views of consolidated power tips with deformable members interfacing with input ports of varying sizes.
Figure 5B:
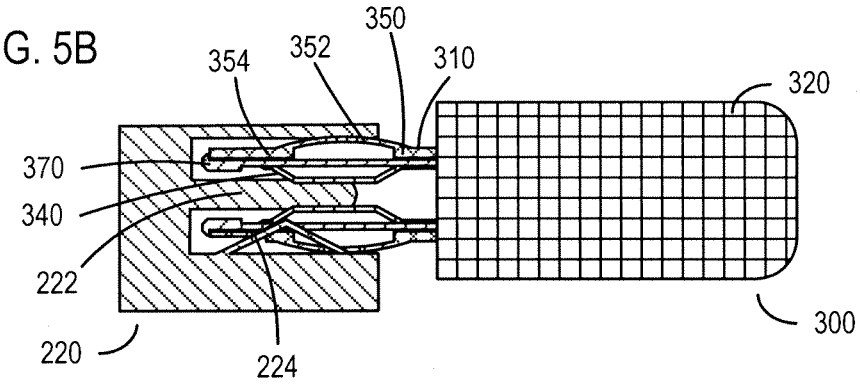
Figure 5C:
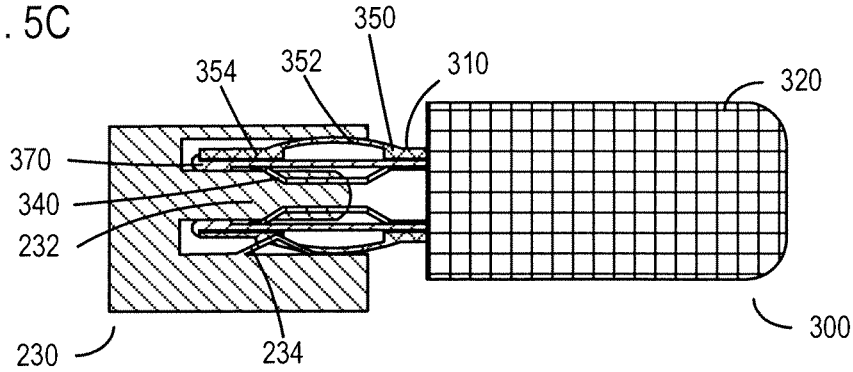

FIGS. 5A-C are cross-section views of the fourth consolidated power tip 300 interfacing with input ports 210, 220, 230 of varying sizes and design. The deformable members 352 are compressed by the input ports 210, 220, 230. As a result, the deformable members 352 exert a normal force against the sides of the input ports 210, 220, 230. This allows the power tip 300 to maintain acceptable insertion and pull resistances over a larger variance of input port sizes. Additionally, this may create a better electrical connection between the electrical contacts 340, 350 of the power tip 300 and the input port pins 212, 222, 232 and electrical contacts 214, 224, 234 of the input ports 210, 220, 230. The deformable member 352 may not run along the entire length of the cylinder in some embodiments. The deformable members 352 may be disposed proximally to the housing 320 and a conductive or insulating cylindrical section 354 may be disposed distally from the housing 320. This may cause the power tip 300 to exhibit preferable insertion and/or pull resistances for a wider set of variably sized input ports.

Figure 4A:
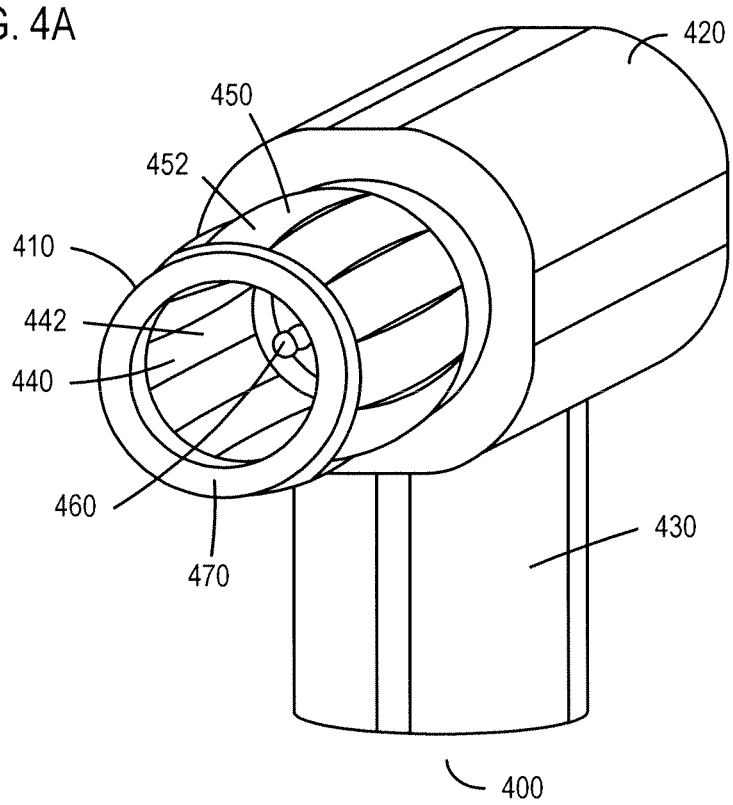
FIGS. 4A and B are a front angled view and a head-on view of another embodiment of a consolidated power tip with deformable members incorporated into the electrical contacts.
Figure 4B:
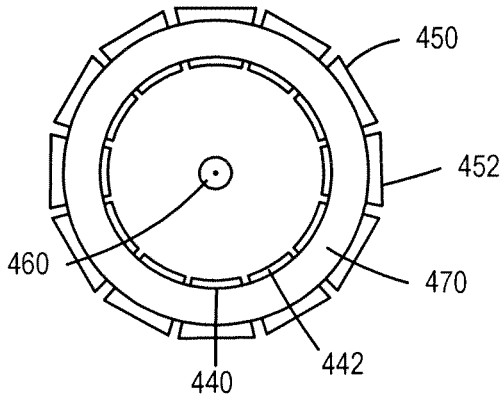

FIGS. 4A and 4B are a front angled view and a head-on view of a fifth consolidated power tip 400 with deformable members. Like the second consolidated power tip 100*b*, the device interface 410 of the consolidated power tip 400 may comprise a housing 420, a base 430, and a center pin 460. The device interface 410 may further comprise a cylinder with the first electrical contact 440 disposed on the inner surface of the cylinder. Alternatively, the first electrical contact may be disposed on the center pin 460, or a user may select between the inner surface of the cylinder 410 and the center pin 460 acting as the first electrical contact. The device interface 410 may comprise a second electrical contact 450 attached to the outer surface of the cylinder. The inner surface and outer surface of the cylinder may be separated by an insulator 470. The first electrical contact 440 disposed on the inner surface of the cylinder may comprise a plurality of deformable members 442. The second electrical contact 450 may also comprise a plurality of deformable members 452 on the outer surface of the cylinder. The deformable members 442, 452 may be arched strips of a conductive material and the center of the arch may be a chosen height above the outer surfaces of the cylinder. In alternate embodiments, the deformable members 442, 452 may be only on the outer surface or only on the inner surface of the cylinder. The pin 460 may also comprise deformable members in some embodiments.

Figure 5D:
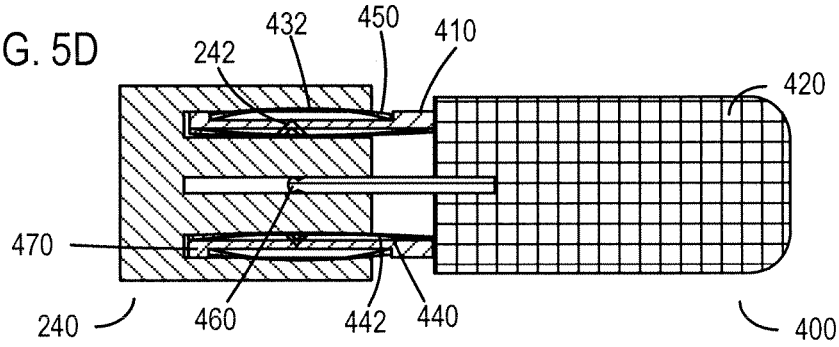
Figure 5E:
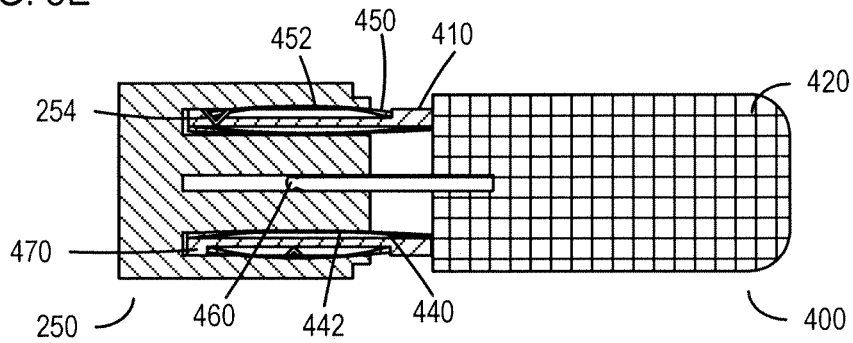

FIGS. 5D and 5E are cross-section views of the fifth consolidated power tip 400 interfacing with input ports requiring pins 240, 250. As with the fourth consolidated power tip 300, the consolidated power tip 400 may exhibit more desirable insertion and/or pull resistances over a wider range of input ports. Further, the deformable members 442, 452 may create a better electrical connection between the second electrical contact 450 of the power tip 400 and the electrical contacts 242, 254 of the input ports 240, 250.

Figure 6A:
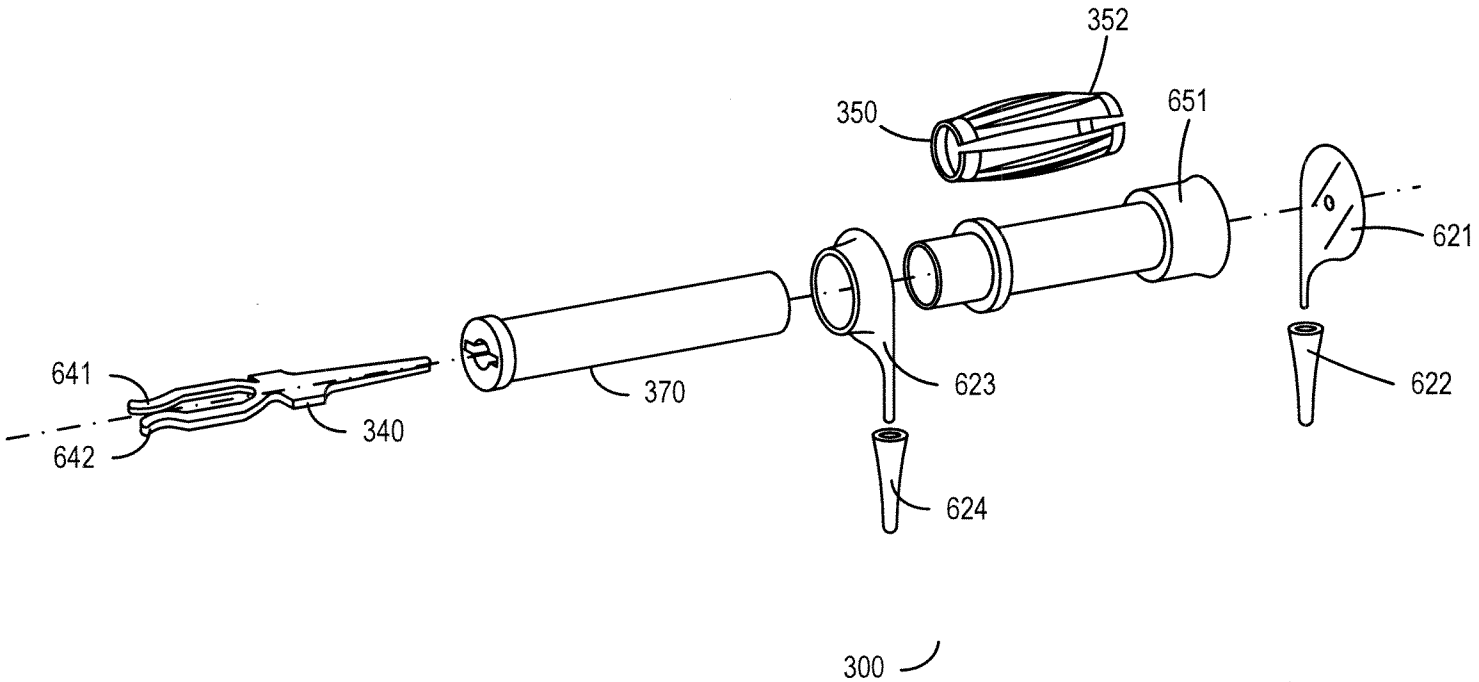
FIGS. 6A and B are expanded and interior views of an embodiment of a consolidated power tip with deformable members.

FIG. 6A is an expanded view of the fourth consolidated power tip 300. The first electrical contact 340 may be fabricated as a single piece, such as the pitchfork-shaped unit 340 illustrated. The prongs 641, 642 of the first electrical contact 340 may be bent towards one another at the distal end to create the arched contacts. The prongs 641, 642 may be substantially parallel at the proximal end to allow for more flex. The first electrical contact 340 may be housed by the cylindrical insulating section 370. The proximal end of the first electrical contact 340 may electrically couple with a first electrical intermediary 621, which may electrically couple with a first electrical pin 622. An outer cylinder 651 may house the cylindrical insulating section 370. The second electrical contact 350 may comprise the conductive deformable members 352 attached to an outer surface of the outer cylinder 651. In some embodiments, some or all of the outer cylinder may comprise a conductive surface. A second electrical intermediary 623 may surround the outer cylinder 651 and may be electrically coupled to the second electrical contact 350. The second electrical intermediary 623 may then be electrically coupled with a second electrical pin 624.

Figure 6B:
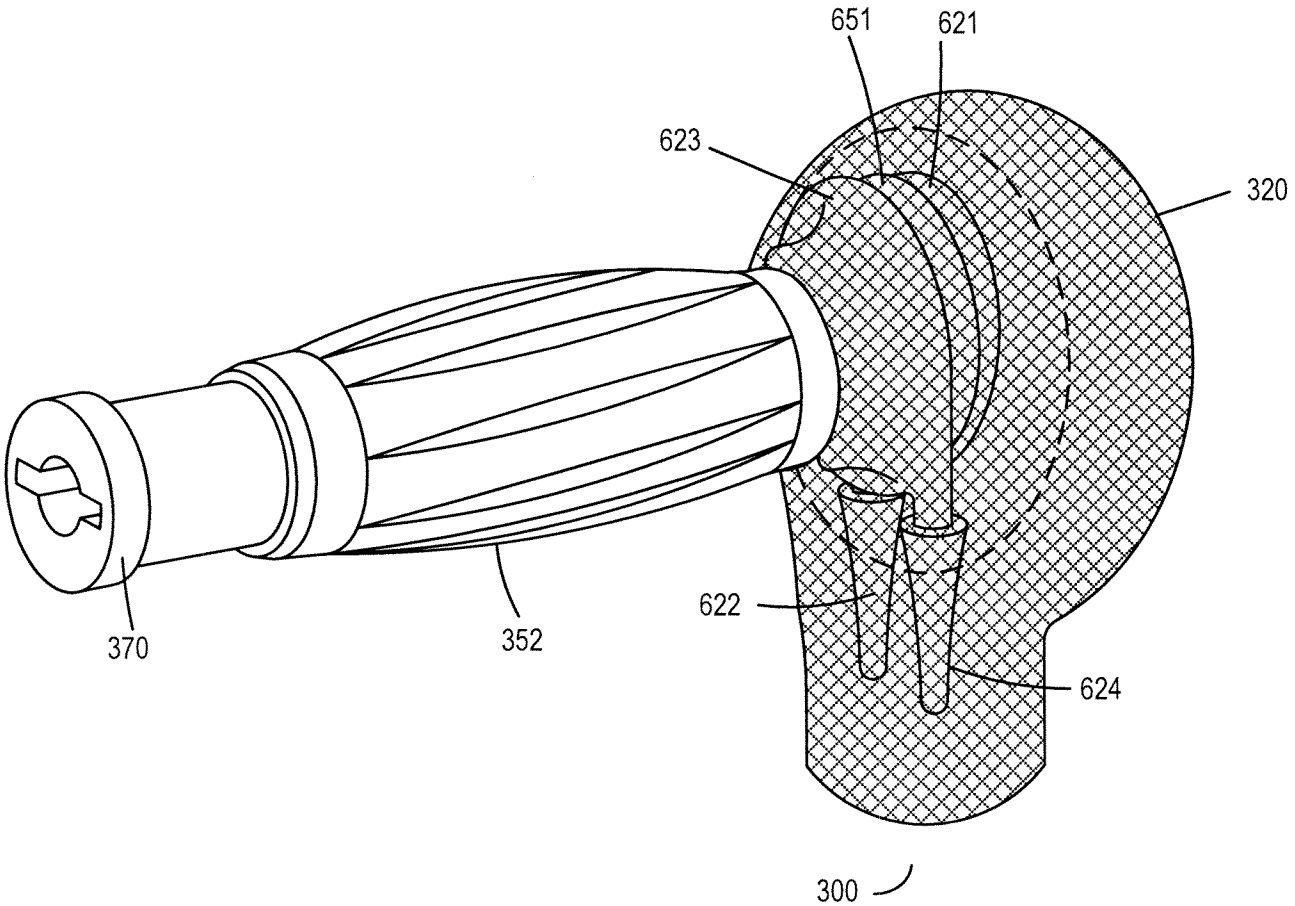

FIG. 6B is a view of the interior of the housing 320 for the assembled power tip 300. The electrical pins 622, 624 are exposed through the bottom of the base to allow for electrical coupling with an intermediate output connector from a power adaptor. In the illustrated embodiment, the outer cylinder 651 acts as an insulator preventing the first electrical intermediary and second electrical intermediary from directly electrically coupling.

Consolidated Power Tips with Selectable Output Mode

If a programmable power adaptor automatically determines electrical requirements based on the power tip connected to it, it may not be able to determine electrical requirements from a consolidated tip. Alternatively, a power tip may be designed to regulate the electrical power provided, such that it complies with electrical requirements of disparate electronic devices. Some consolidated power tips with a center pin may be designed to couple with input ports that use the center pin for different purposes, such as to act as a first electrical contact or to communicate PSID information. In any of these situations, a user may need to select different modes for the power tip based on the electrical requirements of different input ports. The consolidated power tip may comprise a mode selector to choose the appropriate output mode or the input port of interest.

Figure 7A:
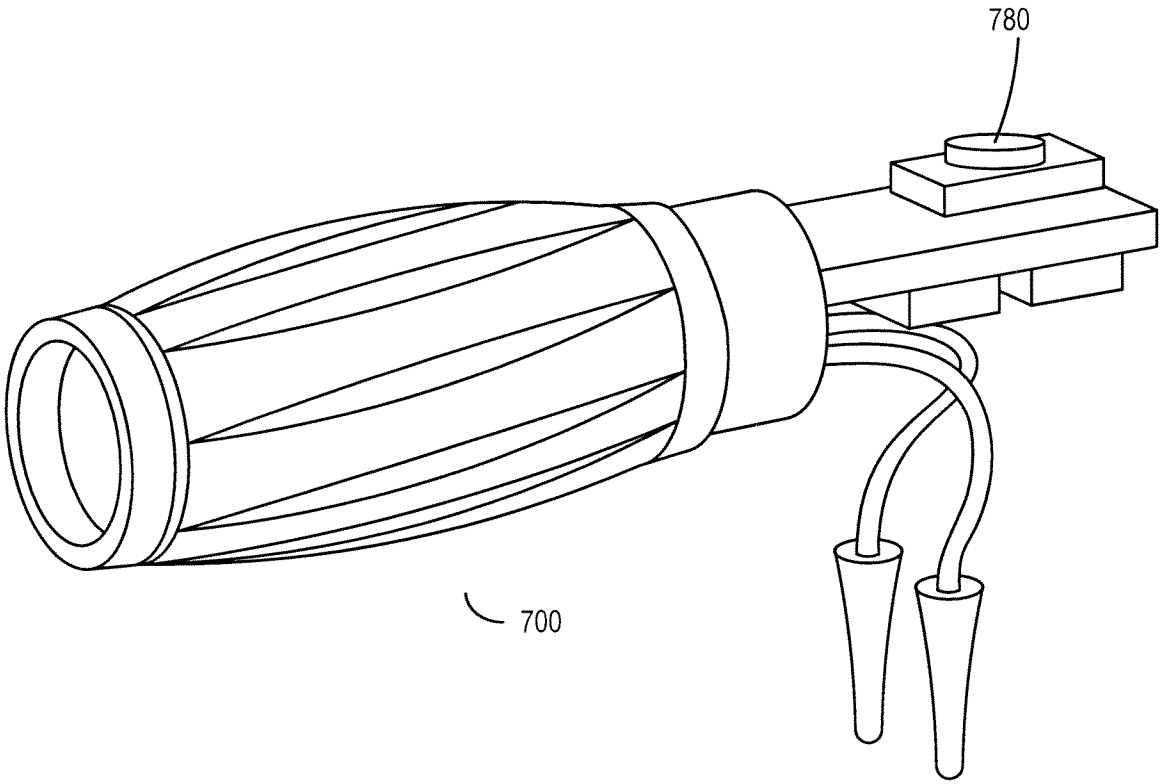
FIGS. 7A and B are interior and covered views of another embodiment of a consolidated power tip incorporating a tactile button to select the electrical configuration of the consolidated power tip.
Figure 7B:
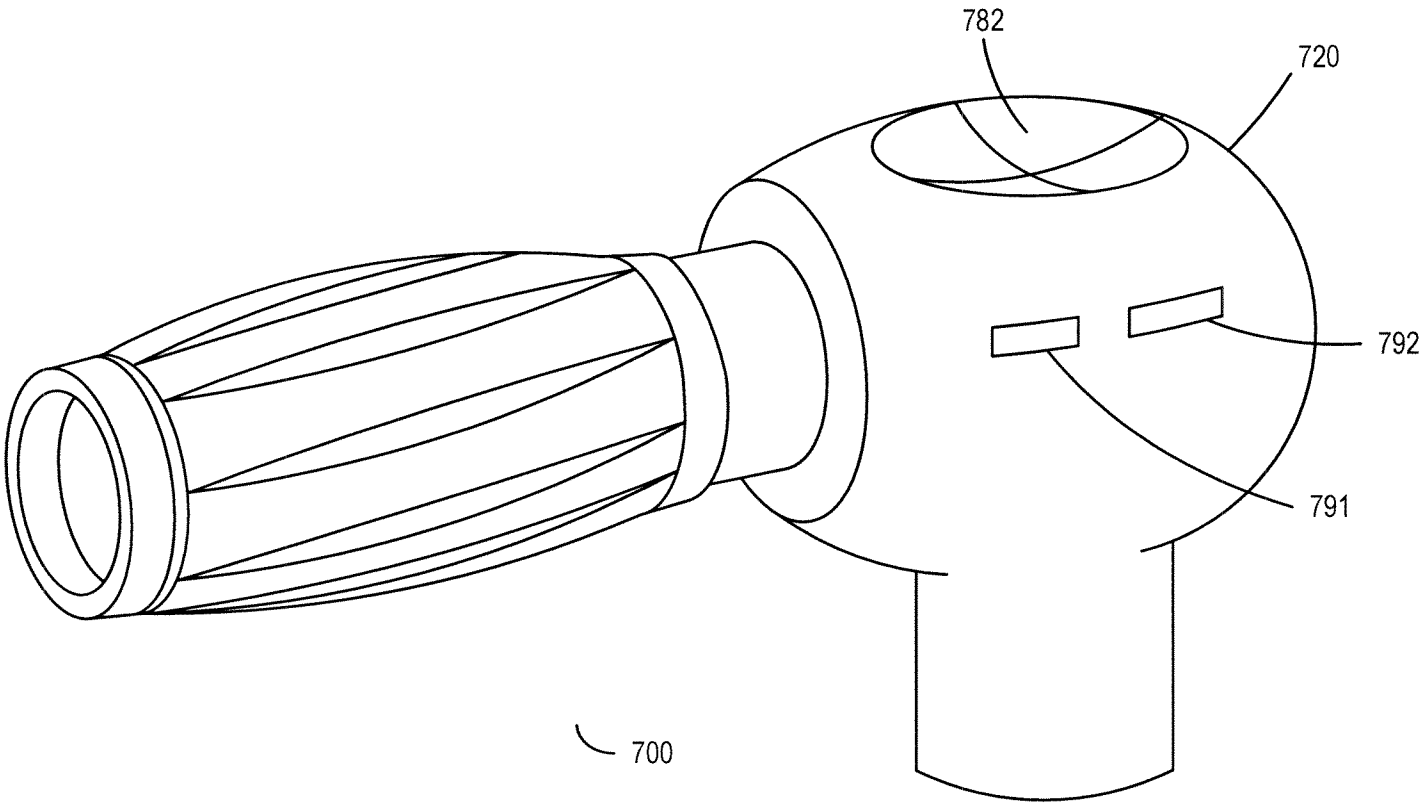

FIG. 7A is an interior view of a consolidated power tip 700 with a tactile button 780. The tactile button 780 may be pushed to select different output modes for the consolidated power tip and/or power adaptor. Each output mode may cause the power output by the power tip and power adaptor to comply with the electrical requirements of a different electronic device. Alternatively or additionally, different output modes may comprise different smart pin programming, such as with a memory or with a resistor. FIG. 7B shows a housing 720 for the consolidated power tip. In the illustrated embodiment, a flanged cover area 782 allows the tactile button (not shown) to be pushed through the housing 720. A pair of light-emitting diodes ("LEDs") 791, 792 may display the currently selected output mode through windows in the housing. In the illustrated embodiment, there are two output modes and each LED corresponds to an output mode. In this embodiment, one LED and only one LED is lit to indicate which mode the consolidated power tip is in. In alternate embodiments, there may be more than two output modes, more or less than two LEDs, alternative methods of lighting the LEDs to indicate the output mode, and/or a different type of indicator to communicate the mode to a user.

Figure 8A:
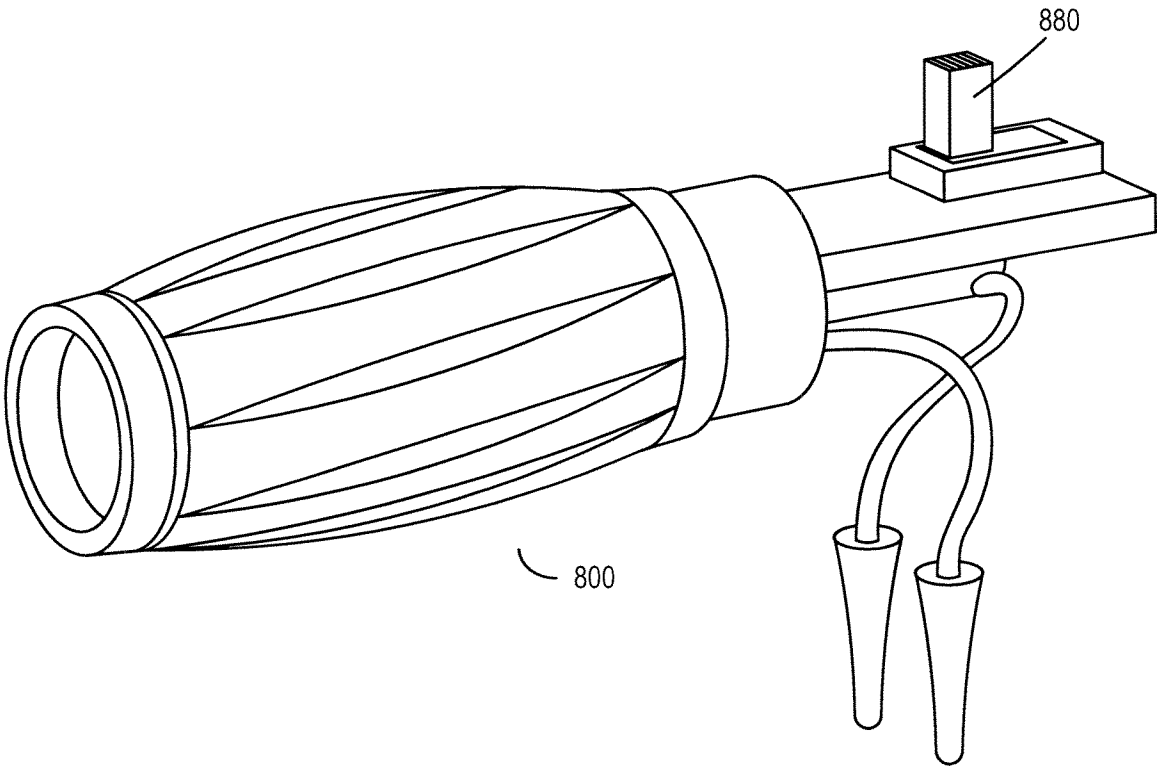
FIGS. 8A-C are interior, expanded, and covered views of alternate embodiments of consolidated power tips incorporating a switch to select the electrical configuration of the consolidated power tip.
Figure 8B:
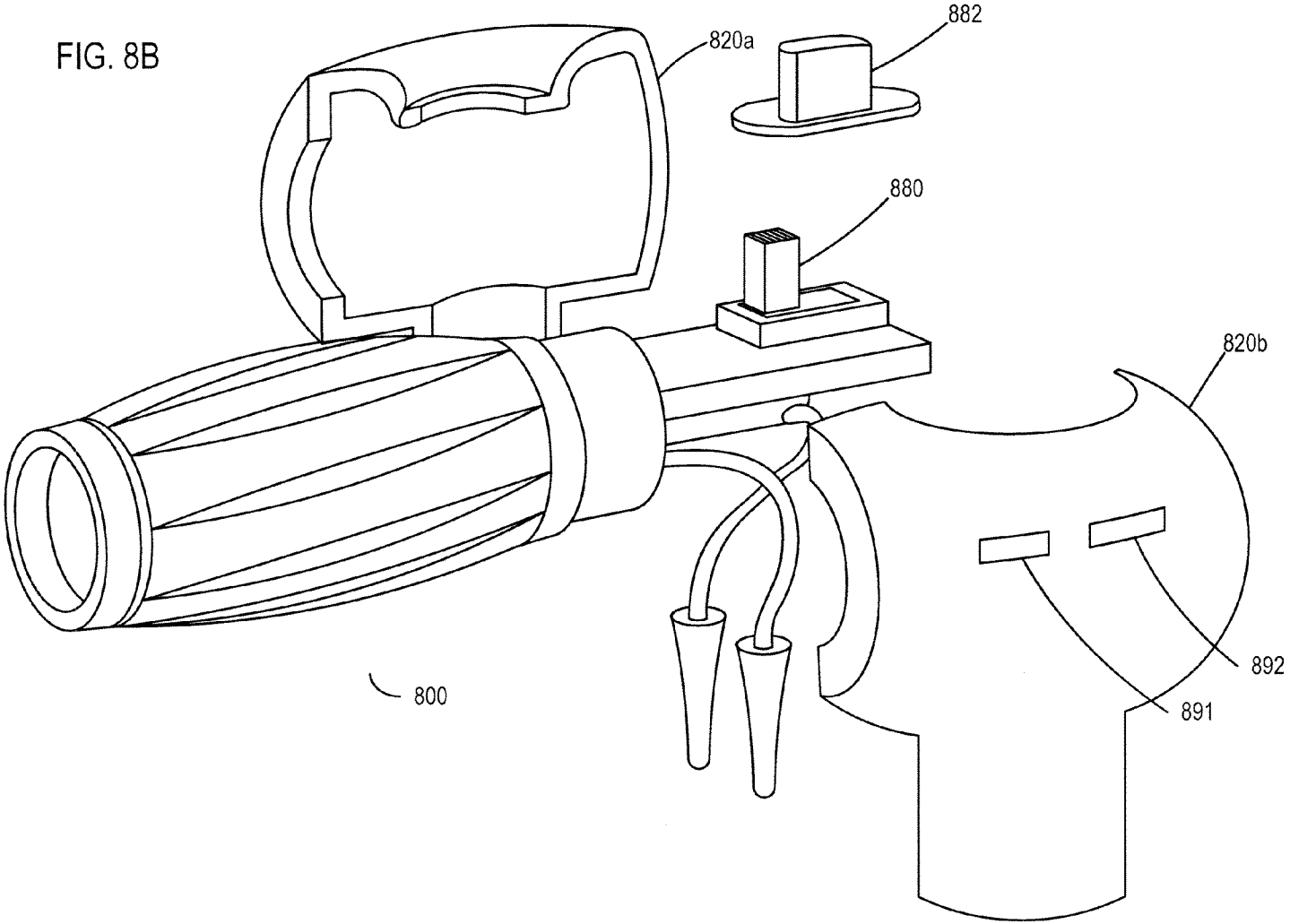
Figure 8C:
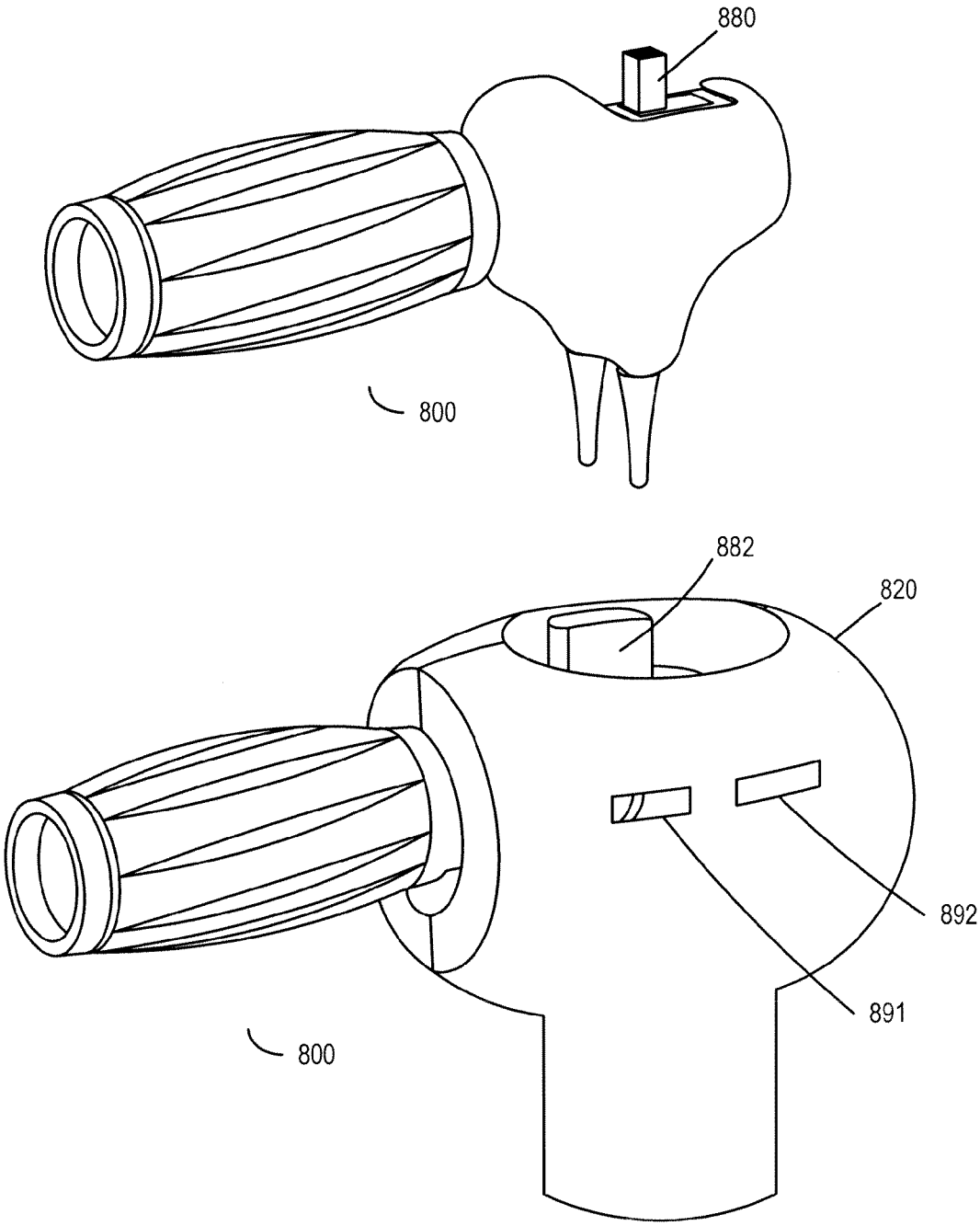

FIGS. 8A-C are interior, expanded, and covered views of another embodiment of a consolidated power tip 800 with a switch 880 for selecting output mode. A cover 882 made from a user friendly material, such as rubber or plastic, may house the switch. The illustrated switch 880 may select up to two different output modes. In other embodiments, a three-way switch or higher may be used to select more than two output modes. In some embodiments, the consolidated power tip 800 comprises LEDs 891, 892 to display the currently selected output mode. In other embodiments, labels on the housing 820 may indicate the output mode based on the position of the switch. FIG. 8B shows that the housing 820 may comprise two halves 820*a*, 820*b* that may be manufactured separately and combined during assembly of the power tip.

Multi-Prong Power Tips

Power tips may be made even more convenient for users by combining the consolidated power tips into a single multi-prong power tip. The multi-prong power tip may incorporate the device interfaces from many power tips into a single housing. In some embodiments, the multi-prong power tip may be removably coupled with the power adaptor via an intermediate output connector. In other embodiments, the multi-prong power tip is permanently coupled with the power adaptor. Users do not need to change power tips if the multi-prong power tip can couple with all devices of interest to the users. A permanently coupled multi-prong power tip able to interface with a large number of devices may also prevent users from losing power tips as may occur if the users have large numbers of individual power tips. Finally, it may simplify the power tip selection process by allowing users to quickly try each prong of the multi-prong power tip.

Figure 9:
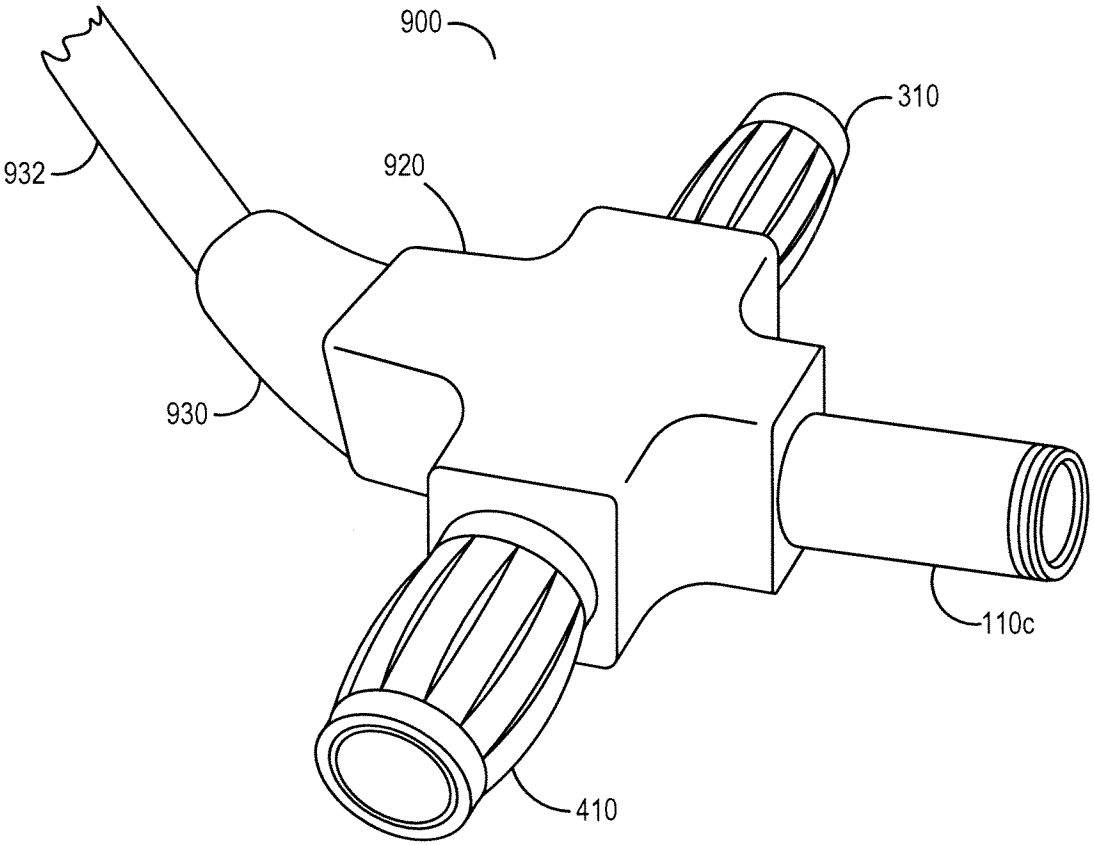
FIG. 9 is a top view of an embodiment of a multi-prong power tip.

FIG. 9 is a top view of a multi-prong power tip 900. The multi-prong power tip 900 comprises three of the above disclosed device interfaces 310, 410, 110*c*. This allows the multi-prong power tip to couple with any input port that the device interfaces 310, 410, 110*c* could couple with. In the illustrated embodiment, two device interfaces 310, 410 comprise deformable members while the third device interface 110*c* does not. Other device interfaces may be used instead of or in addition to the device interfaces illustrated. For example, some device interfaces may be designed to interface with only one particular input port. A universal serial bus ("USB") port or a USB wire may be an interface in some embodiments. The device interfaces 310, 410, 110*c* may all lie in the same plane, as illustrated, or the device interfaces 310, 410, 110*c* may occupy a three dimensional space. The angle between the device interfaces 310, 410, 110*c* may be 45, 60, 90, 109.5, 120, 135, 150, or 180 degrees or the like. In other embodiments, the device interfaces 310, 410, 110*c* are parallel or disposed in an asymmetrical pattern. The multi-prong power tip 900 may be configured to allow for folding, moving, or other repositioning of the device interfaces 310, 410, 110*c*. The power tip 900 further comprises a single housing 920 for all of the device interfaces 310, 410, 110*c* and a flexible permanent attachment 930 to a power adaptor cord 932.

In some embodiments, the multi-prong power tip 900 is attached to a programmable power adaptor. The programmable power adaptor 900 may provide power to all device interfaces 310, 410, 110*c*. This may allow a user to quickly try all possible device interfaces 310, 410, 110*c* on an input port of an electronic device without the need to look up which device interface to use. Alternatively, the programmable power adaptor may provide power to a single "hot" device interface 310, 410, 110*c* based on a user selection. Permitting only a single device interface 310, 410, 110*c* to be hot may be accomplished by sending a signal to selection circuitry in the multi-prong power tip 900 or by supplying each device interface 310, 410, 110*c* with different wires. For example, each device interface 310, 410, 110*c* may be supplied by the same ground wire but have its own power wire.

Figure 10:
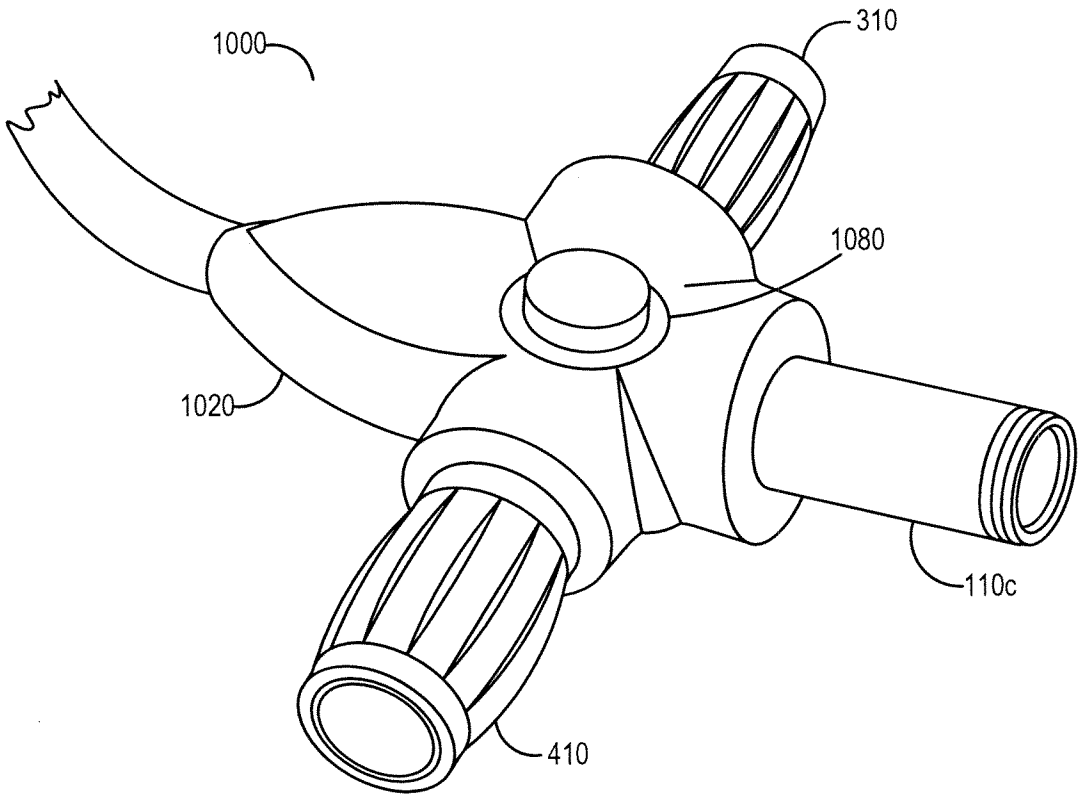
FIG. 10 is a top view of an alternate embodiments of a multi-prong power tip with a tactile button to select the electrical configuration of one or more device interfaces.

FIG. 10 is a top view of an alternate embodiment of a multi-prong power tip 1000 with a mode selector 1080 configured to select an output mode for one or more device interfaces. In this embodiment, the mode selector 1080 is a button in the center of the housing 1020. In other embodiments, the mode selector 1080 may be a switch and/or may be located elsewhere on the multi-prong power tip 1000, such as closer to the power cord. The mode selector 1080 may select which device interface 310, 410, 110*c* is hot. Alternatively, the mode selector 1080 may regulate the provided electrical power such that it complies with electrical requirements of a device of interest, may determine which component of a device interface 310, 410, 110*c* acts as an electrical contact, or may determine a type of smart pin programming. In some embodiments, the multi-prong power tip 1000 may comprise more than one mode selector.

Figure 11A:
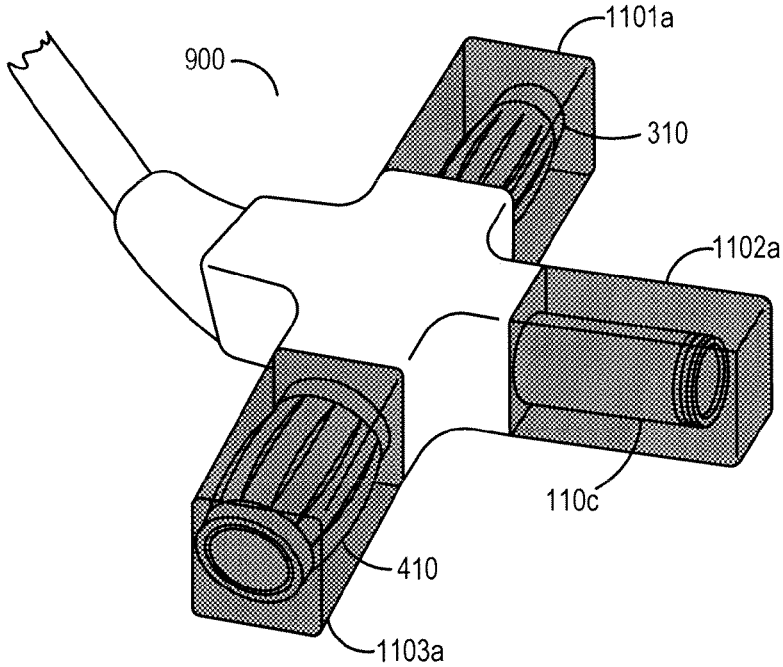
FIGS. 11A and B are top views of the multi-prong power tips of FIGS. 9 and 10 with covers over the device interfaces.
Figure 11B:
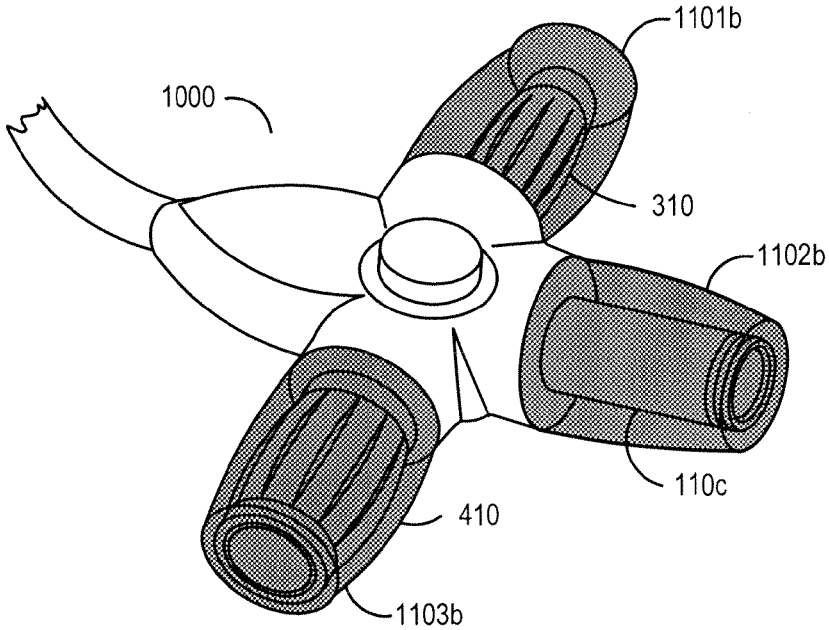

FIGS. 11A and B are top views of the multi-prong power tips 900, 1000 with covers 1101*a-b*, 1102*a-b*, 1103*a-b* over the device interfaces 310, 410, 110*c*. The covers 1101*a-b*, 1102*a-b*, 1103*a-b* may protect the device interfaces 310, 410, 110*c* from damage and/or exposure that may result in poorer electrical coupling with input ports. The illustrated covers 1101*a-b*, 1102*a-b*, 1103*a-b* are smooth, but in other embodiments, they may be grooved, bumpy, or the like to improve gripping and removal. In some embodiments, the multi-prong power tips 900, 1000 may sense when a cover 1101*a-b*, 1102*a-b*, 1103*a-b* has been removed, or the cover 1101*a-b*, 1102*a-b*, 1103*a-b* may engage a switch. The multi-prong power tip 900, 1000 may provide power to only the device interfaces 310, 410, 110*c* with the cover 1101*a-b*, 1102*a-b*, 1103*a-b* removed. Alternatively, the power adaptor or multi-prong power tip 900, 1000 may attempt to determine the electrical requirements of an electronic device based on the last cover 1101*a-b*, 1102*a-b*, 1103*a-b* that was removed.

It will be obvious to those having skill in the art that many changes may be made to the details of the above-described embodiments without departing from the underlying principles of the disclosure. The scope of the present disclosure should, therefore, be determined only by the following claims.

The invention claimed is:

1. A multi-interface power tip to couple electrically to a power adaptor and to couple alternatingly with variably sized input ports of electronic devices, the multi-interface power tip comprising:

a housing;

a first device interface having a first size and shape to electrically couple a power adaptor to an input port of an electronic device, the first device interface at least partially disposed within the housing, the first device interface comprising:

a first electrical contact, and a second electrical contact insulated from the first electrical contact; and a second device interface having a second size and shape to electrically couple the power adaptor to a first plurality of variably sized input ports of a corresponding first plurality of electronic devices, the second device interface at least partially disposed within the housing, wherein the second device interface comprises one or more deformable members, and wherein the second device interface is offset from the first device interface.

2. The multi-prong power tip of claim 1, wherein the second size and shape of the second device interface create a frictional engagement between the second device interface and the first plurality of variably sized input ports, wherein the frictional engagement of the second device interface with the first plurality of variably sized input ports provides a threshold pull resistance, and wherein the frictional engagement of the second device interface with the first plurality of variably sized input ports provides less than a threshold insertion resistance.

3. The multi-prong power tip of claim 1, further comprising a mode selector to select an output mode.

4. The multi-prong power tip of claim 3, wherein the mode selector is a button.

5. The multi-prong power tip of claim 1, wherein power is provided to only one of the first device interface and the second device interface at a time.

6. The multi-prong power tip of claim 5, further comprising a mode selector to select which of the first device interface and the second device interface is powered.

7. The multi-prong power tip of claim 1, further comprising a third device interface having a third size and shape to electrically couple the power adaptor to a second plurality of variably sized input ports of a corresponding second plurality electronic devices, wherein the third device interface is offset from the first and second device interfaces.

8. The multi-prong power tip of claim 7, wherein the first, second, and third device interfaces lie within a single plane.

9. The multi-prong power tip of claim 7, wherein an angle between the first and second device interfaces is 90 degrees, and an angle between the second and third device interfaces is 90 degrees.

10. The multi-prong power tip of claim 7, wherein the third device interface comprises one or more deformable members.

11. The multi-prong power tip of claim 1, further comprising a permanent affixment to the power adaptor.

12. The multi-prong power tip of claim 1, further comprising removable covers over the first device interface and second device interface.

13. A multi-interface power tip to couple electrically to a power adaptor and to couple alternatingly with variably sized input ports of electronic devices, the multi-interface power tip comprising:

a housing;

a first device interface having a first size and shape to electrically couple a power adaptor to an input port of an electronic device, the first device interface at least partially disposed within the housing; and a second device interface at least partially disposed within the housing, the second device interface comprising:

a first electrical contact; and a second electrical contact insulated from the first electrical contact, wherein a second size and shape of the first and second electrical contacts create a frictional engagement between the second device interface and a first plurality of variably sized input ports, wherein the frictional engagement of the second device interface with the first plurality of variably sized input ports provides a threshold pull resistance, wherein the frictional engagement of the second device interface with the first plurality of variably sized input ports provides less than a threshold insertion resistance, wherein at least one of the first electrical contact and the second electrical contact comprises one or more deformable members, and wherein the second device interface is offset from the first device interface.

14. The multi-prong power tip of claim 13, further comprising a mode selector to select an output mode.

15. The multi-prong power tip of claim 14, wherein the mode selector is a button.

16. The multi-prong power tip of claim 13, wherein power is provided to only one of the first device interface and the second device interface at a time.

17. The multi-prong power tip of claim 16, further comprising a mode selector to select which of the first device and the second device interface is powered.

18. The multi-prong power tip of claim 13, further comprising a third device interface having a third size and shape to electrically couple the power adaptor to a second plurality of variably sized input ports, wherein the first, second, and third device interfaces lie within a single plane.

19. The multi-prong power tip of claim 13, wherein an angle between the first and second device interfaces is 90 degrees.

20. The multi-prong power tip of claim 13, further comprising a permanent affixment to the power adaptor.

21. The multi-prong power tip of claim 13, further comprising removable covers on the first device interface and second device interface.

22. A multi-interface power tip to couple electrically to a power adaptor and to couple alternatingly with a plurality of variably sized input ports of a plurality electronic devices, the multi-interface power tip comprising:

a housing;

two or more device interfaces at least partially disposed within the housing, the two or more device interfaces to electrically couple a power adaptor to the plurality of variably sized input ports of the plurality of electronic devices, each device interface comprising:

a first electrical contact; and a second electrical contact insulated from the first electrical contact, wherein at least one of the first electrical contact and the second electrical contact comprises one or more deformable members, and wherein the two or more device interfaces are offset from each other.

* * * * *